US006601803B1

(12) United States Patent
Juranek

(10) Patent No.: US 6,601,803 B1
(45) Date of Patent: Aug. 5, 2003

(54) SLING FOR HOLDING BABY BOTTLE

(76) Inventor: Jennifer Rae Juranek, 20946 Gardengate Cir., Ashburn, VA (US) 20147

( * ) Notice: Subject to any disclaimer, the term of this patent is extended or adjusted under 35 U.S.C. 154(b) by 0 days.

(21) Appl. No.: 10/252,425

(22) Filed: Sep. 24, 2002

(51) Int. Cl.[7] ..... A61J 9/06
(52) U.S. Cl. ..... 248/102
(58) Field of Search ..... 248/102, 104; 297/188.06

(56) References Cited

U.S. PATENT DOCUMENTS

| | | | | |
|---|---|---|---|---|
| 580,837 A | | 4/1897 | Sykes | |
| 2,182,164 A | | 12/1939 | Rosenberg | 248/104 |
| 2,399,320 A | | 4/1946 | Brose et al. | 248/104 |
| 2,428,724 A | | 10/1947 | Stretz | 248/104 |
| 2,490,207 A | * | 12/1949 | Cassille | 248/102 |
| 3,635,431 A | | 1/1972 | Mariner | 248/104 |
| 4,062,510 A | | 12/1977 | Brochu | 248/102 |
| 4,537,341 A | * | 8/1985 | Kelly | 224/620 |
| 4,630,793 A | | 12/1986 | Hunter | 248/102 |
| 4,718,623 A | | 1/1988 | McClure | 248/102 |
| 5,456,432 A | | 10/1995 | Ennis et al. | 248/102 |
| 5,727,842 A | * | 3/1998 | O'Neil | 297/188.06 |
| 5,820,084 A | * | 10/1998 | Trumbauer et al. | 248/102 |
| 5,873,551 A | * | 2/1999 | Jones | 248/102 |
| 5,927,661 A | | 7/1999 | Tinsley et al. | 248/102 |
| 6,055,667 A | | 5/2000 | Jimenez | 2/49.1 |
| 6,098,934 A | * | 8/2000 | Skelton | 248/102 |
| D432,759 S | | 10/2000 | Krolczyk et al. | D2/864 |

FOREIGN PATENT DOCUMENTS

| | | |
|---|---|---|
| FR | 2 615 158 | 11/1988 |
| GB | 2 233 238 | 1/1991 |

* cited by examiner

*Primary Examiner*—Ramon O. Ramirez
(74) *Attorney, Agent, or Firm*—Stephen Christopher Swift; Swift Law Office

(57) ABSTRACT

A sling for holding a baby bottle. In the preferred embodiment, the invention includes a rectangular pad having two stuffed end sections and an unstuffed middle section, on which the bottle rests. An elastic loop helps to hold the bottle in place. The elastic loop is attached to a first strap, which is removably retained on the end sections of the rectangular pad by strips of hook and loop fasteners. Second and third straps are attached to the end sections of the rectangular pad, and have strips of hook and loop fasteners adjacent to their ends, by which they can be. removably retained in loops to hold D-shaped rings. Fabric strips may be attached directly to the rings or to outer straps attached to the rings, with strips of hook and loop fasteners by which they may be removably retained in loops for attachment to narrow elongated objects.

19 Claims, 12 Drawing Sheets

SLING FOR HOLDING BABY BOTTLE

BACKGROUND OF THE INVENTION

1. Field of the Invention

The present invention relates to slings for holding baby bottles.

2. Description of the Prior Art

There have been previous inventions of devices for holding baby bottles so that an infant may access them when an adult is not holding the bottle, but none are equivalent to the present invention.

U.S. Pat. No. 580,837, issued on Apr. 13, 1897, to Joshua W. Sykes, discloses a holder for nursery bottles. The bottle is held in something resembling a wire cage, rather than on fabric, as in the instant invention.

U.S. Pat. No. 2,182,164, issued on Dec. 5, 1935, to Max B. Rosenberg, discloses a bottle holder, which resembles a sling, by which a baby bottle can be suspended between the side rails of a crib. The instant invention is distinguishable, in that it makes use of adjustable straps and Velcro.

U.S. Pat. No. 2,399,320, issued on Apr. 30, 1946, to Lazetta D. Brose and Horace B. Brose, discloses a nursing bottle support, in which the bottle is held in a fabric pocket that is suspended from the side rails of a crib. Again, it does not make use of adjustable straps or Velcro.

U.S. Pat. No. 2,428,724, issued on Oct. 7, 1947, to Frank L. Stretz, discloses another holding appliance for nursing bottles, in which the bottle is suspended in a "cradle" of fabric or other flexible material.

U.S. Pat. No. 3,635,431, issued on Jan. 18, 1972, to Charlie Dwain Mariner, discloses a bottle holder, in which a baby bottle is held up on a seat by wires, rather than suspended.

U.S. Pat. No. 4,062,510, issued on Dec. 13, 1977, to Edward Brochu, discloses a nursing bottle holder, in which the bottle is held by a plurality of straps between bars on a crib.

U.S. Pat. No. 4,630,793, issued on Dec. 23, 1986, to Leslye Hunter, discloses a baby bottle holder in which the bottler is held in the middle of a belt removably attached to a pair of arms extending from a child's seat. The invention is distinguishable, in that only it includes the use of adjustable straps with Velcro and D-shaped buckles.

U.S. Pat. No. 4,718,623, issued on Jan. 12, 1988, to Alice M. McClure, discloses a sling for holding a baby bottle while traveling. It includes the use of straps with hook and loop tape (i.e., Velcro strips) and D-shaped metal rings. But the straps are designed to be fastened together, rather than to opposite side rails. The instant invention is distinguishable, in that it has fabric loops at the ends of adjustable straps for attachment to side rails.

U.S. Pat. No. 5,456,432, issued on Oct. 10, 1995, to G. Thomas Ennis and Manochehr Shoushtari, discloses an adjustable baby bottle holder with Velcro straps, but also including an L-shaped body member not required by the instant invention.

U.S. Pat. No. 5,727,842, issued on Mar. 17, 1998, to James G. O'Neil, discloses a device for attaching baby bottles to car seats, including a sling filled with foamed plastic. The bottle is retained by a holding cord on the sling.

U.S. Pat. No. 5,927,661, issued on Jul. 27, 1999, to Kevin L. Tinsley and Lianna Peters-Tinsley, discloses a baby bottle suspension apparatus, secured to the handle of a baby car seat by Velcro straps. The instant invention is distinguishable, in that it includes a padded fabric rectangle.

U.S. Pat. No. 6,055,667, issued on May 2, 2000, to Diane Jimenez, discloses a baby bottle and sip cup bib support. The baby bottle is held on a bib in which a foam wedge is placed.

U.S. Pat. No. Des. 432,759, issued on Oct. 31, 2000, to Kenneth Krolczyk and Virginia Krolczyk, discloses a design for a multi-purpose bib, on which a baby bottle can be retained.

British Patent Application No. 2 233 238, published on Jan. 9, 1991, by Marie Louise Palmer and Kenneth Allan Jackson, discloses a portable drink/food container restrainer, which may be used to retain a baby's bottle on a baby's buggy harness.

French Patent Application No. 2 615 158, published on Nov. 18, 1988, by Louis Gaspard, discloses a can holder or holder for similar objects, which could be used to hold a baby bottle.

None of the above inventions and patents, taken either singly or in combination, is seen to describe the instant invention as claimed.

SUMMARY OF THE INVENTION

The purpose of the present invention is to hold up a baby's bottle while the baby is feeding. The bottle is held loosely, not rigidly, by the sling, so that should the baby fall asleep, gag, or finish the bottle, the bottle will fall free from his or her mouth to prevent choking. A first set of attachments allow the sling to be used on an infant's stroller, carrier or car seat. A second set of attachments allow the carrier to be used on a baby swing. When the baby is not using a bottle, the sling can be removed, folded up compactly, and stored in a diaperbag or elsewhere.

Accordingly, it is a principal object of the invention to provide an improved means for holding up a baby bottle when an infant is feeding.

It is another object of the invention to provide a means for holding a baby bottle that will not place an infant in danger of choking.

It is a further object of the invention to provide a means of holding a baby bottle that maybe used in a stroller, carrier or car seat.

Still another object of the invention is to provide a means of holding a baby bottle that can be used on a baby swing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a sling for holding a baby bottle, which relieves adults from having to constantly hold the bottle for the baby.

Figure 1:
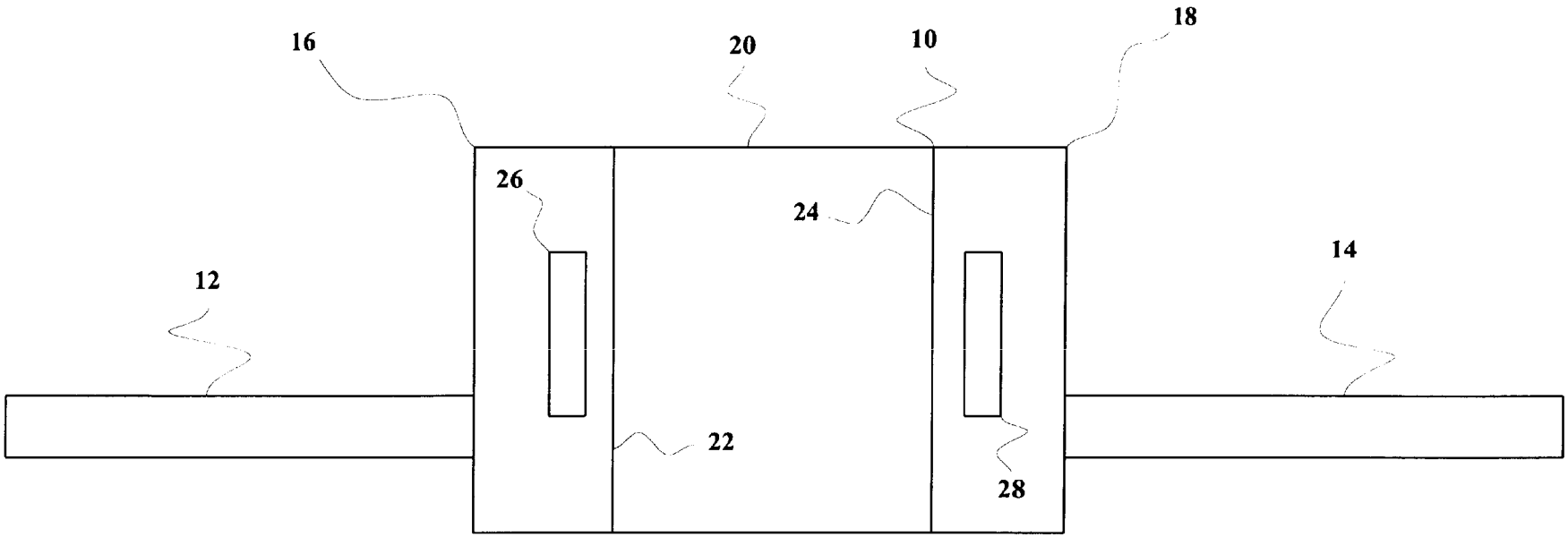
FIG. 1 is top plan view of the rectangular pad and the straps that are attached to it in the preferred embodiment of the invention.

FIG. 1 is top plan view of the rectangular pad 10 and the straps 12 and 14 that are attached to it in the preferred embodiment of the invention. The rectangular pad is comprised of two fabric rectangles that are sewn together at their edges. It has stuffed end sections 16 and 18 and an unstuffed middle section 20. The sections are separated by stitching along the boundaries 22 and 24 of the sections. The end sections are stuffed with polyester filling or other suitable soft, flexible and resilient material. There are strips of hook and loop fasteners (i.e., VELCRO®) 26 and 28 on the upper surfaces of the end sections. The bottle is retained on the unstuffed middle section, while the stuffed end sections help to hold it in place. Alternatively, other suitable pads may be used in place of the rectangular pad of the preferred embodiment.

Figure 2:
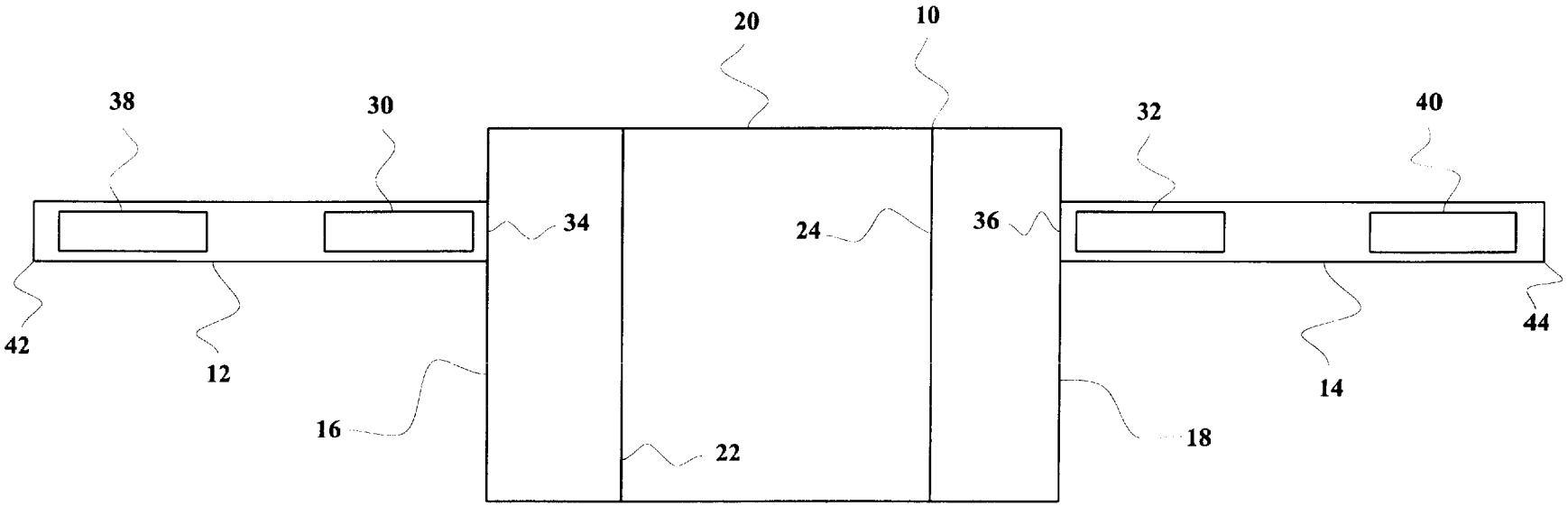
FIG. 2 is a bottom plan view of the rectangular pad and the straps that are attached to it in the preferred embodiment of the invention.

FIG. 2 is a bottom plan view of the rectangular pad and the straps that are attached to it. The straps 12 and 14 ("inner straps") each have a strip of hook and loop fasteners 30 and 32 near the end 34 and 36 at which the strap is sewn to the fabric rectangle, and a strip of hook and loop fasteners 38 and 40 near the opposite end 42 and 44 of the strap. The strips on each strap can engage to form loops, because one strip is of hook fasteners and the other strip is of loop fasteners. (Whenever it is stated in this patent that strips of hook and loop fasteners can engage, it is meant that one strip is of hooks and the other strip is of loops, but it is not usually specified which strip is which, because their positions can always be reversed.)

Figure 3:
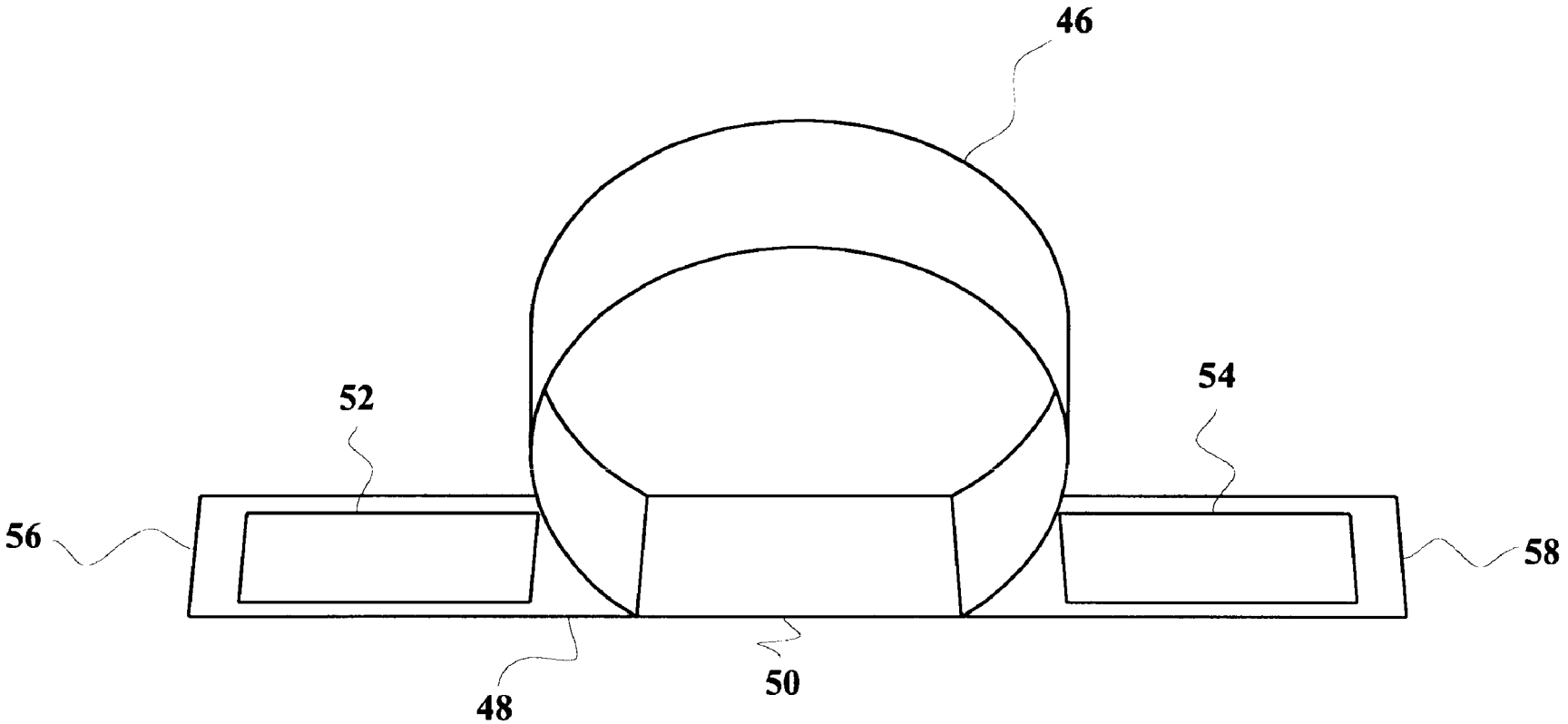
FIG. 3 is a perspective view of the elastic loop and the strap that is attached to it in the preferred embodiment of the invention.

FIG. 3 is a perspective view of the elastic loop 46 and the strap 48 that is attached to it. The elastic loop is sewn to a middle section 50 of the strap. There are strips of hook and loop fasteners 52 and 54 sewn to end sections 56 and 58 of the strap, which can engage the strips of hook and loop fasteners on the end sections of the rectangular pad to retain the elastic loop on the pad. The baby's bottle can then be inserted into the loop to help retain it on the rectangular pad.

Figure 4:
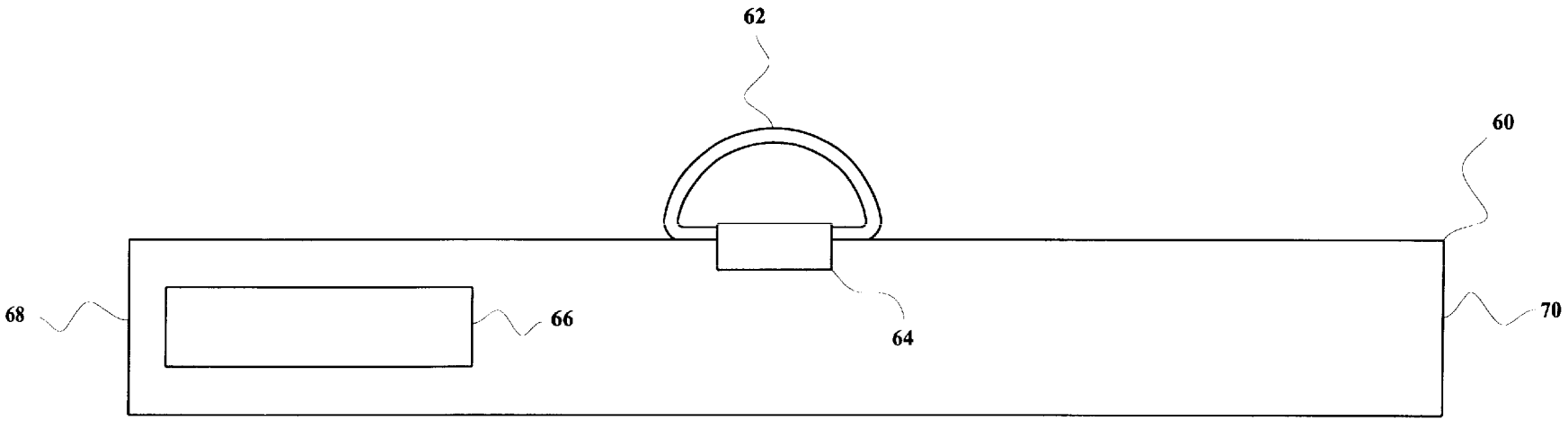
FIG. 4 is a top plan view of one of the fabric loops in an open position, with the bottom plan view being identical, in the preferred embodiment of the invention.

FIG. 4 is a top plan view of one of the fabric loops 60 in an open position, with the bottom plan view being identical. A D-shaped ring 62 is retained on the fabric strip by a small strap 64 that is sewn to the fabric strip. There is a strip of hook and loop fasteners 66 adjacent to a first end 68 of the fabric strip that can engage a strip of hook and loop fasteners on the other side of the strip adjacent to a second end 70, to close the strip into a fabric loop, by which the sling can be retained on narrow elongated objects, such as a handle or railing on a baby stroller, carrier or car seat. Two of these fabric loops with attached rings constitute the first set of attachments for the sling. The rings are retained on the loops formed by the straps that are attached to the rectangular pad.

Figure 5:
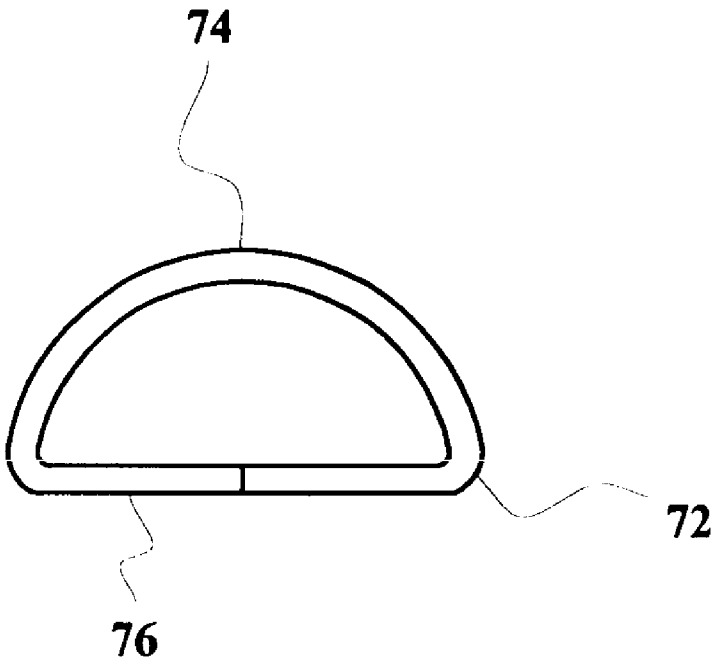
FIG. 5 is a top plan view of one of the D-shaped rings used in the preferred embodiment of the invention.

FIG. 5 is a top plan view of one of the D-shaped metal rings 72 used in the preferred embodiment of the invention, having a rounded portion 74 and a flat portion 76. Any other suitable rings or attachment devices may be substituted.

Figure 6:
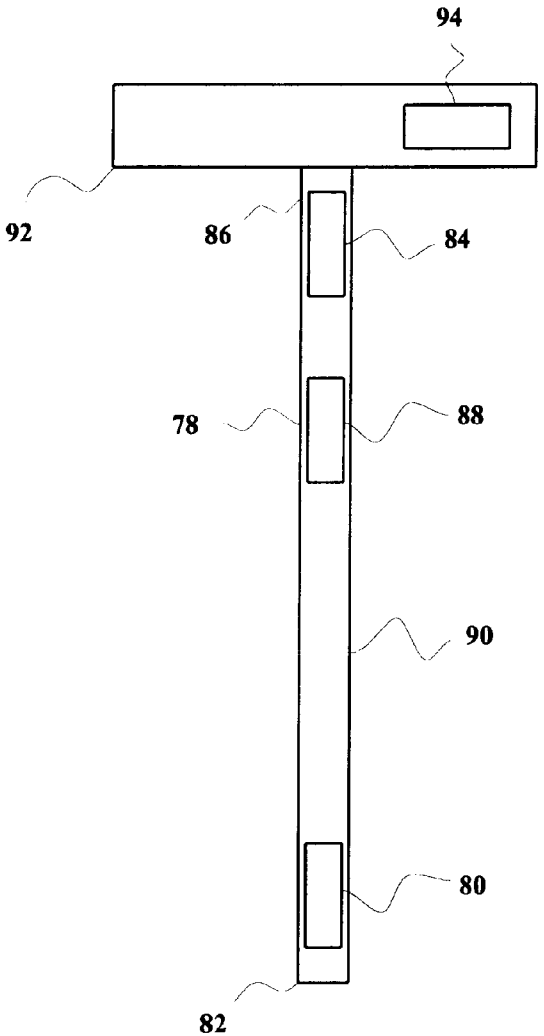
FIG. 6 is a top plan view of one of the longer straps in an open position, in the preferred embodiment of the invention.

FIG. 6 is a top plan view of one of the longer straps 78 in an, open position, which may be used for the back legs of a baby swing. A first strip of hook and loop fasteners 80 adjacent to a first end 82 of the strap can engage either a second strip of hook and loop fasteners 84 adjacent to an opposite second end 86 of the strap to form a larger loop, or a third strip of hook and loop fasteners 88 adjacent to the middle 90 of the strap to form a smaller loop. This enables the length of the loop to be adjusted. Alternatively, the first strip may engage an elongated strip of hook and loop fasteners (not shown in the drawings) between the second end and the middle of the strap, so that the first strip may be engaged in a range of positions to form loops having a range of sizes. Or there may be only two strips of hook and loop fasteners adjacent to the ends of the strap, if no adjustment is needed. A fabric loop 92, having a strip of hook and loop fasteners 94, may be sewn to either end of the strap.

Figure 7:
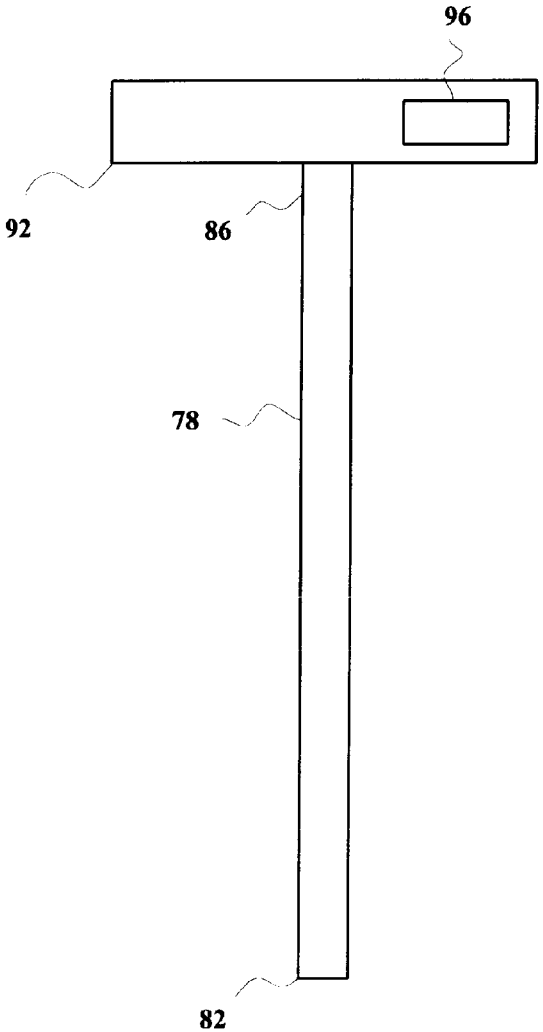
FIG. 7 is a bottom plan view of one of the longer straps in an open position, in the preferred embodiment of the invention.

FIG. 7 is a bottom plan view of one of the longer straps in an open position. A second strip of hook and loop fasteners 96 can engage the strip of hook and loop fasteners on the other side of the fabric strip, to close the strip into a fabric loop, by which the sling can be retained on narrow elongated objects, such as the legs of a baby swing.

Figure 8:
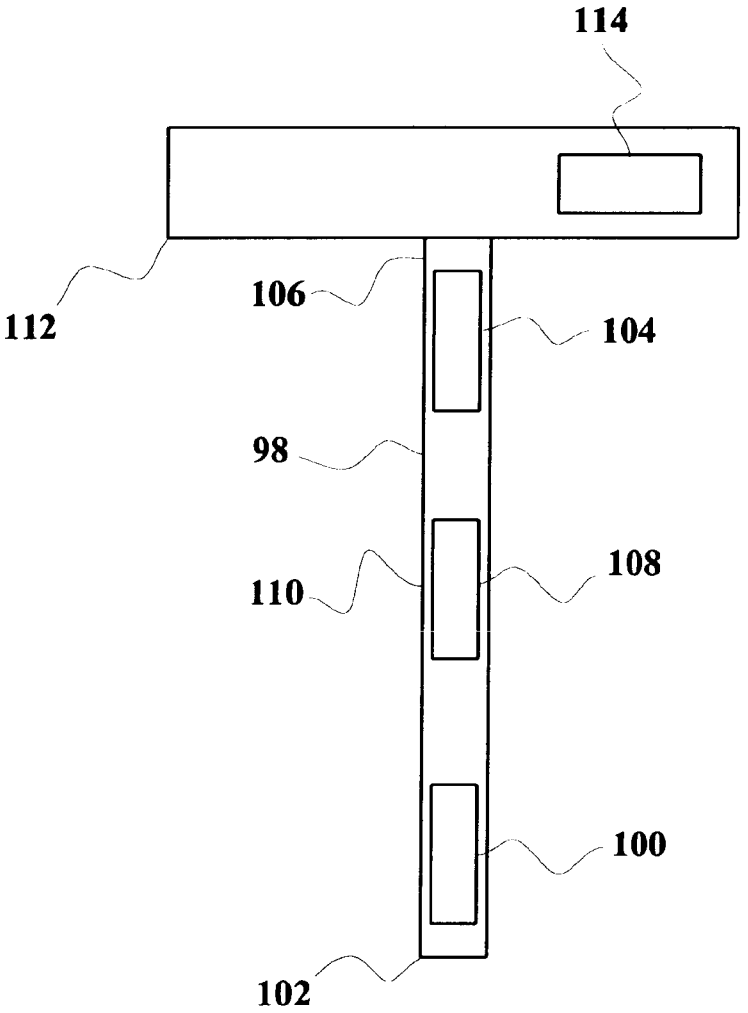
FIG. 8 is a top plan view of one of the shorter straps in an open position, in the preferred embodiment of the invention.

FIG. 8 is a top plan view of one of the shorter straps 98 in an open position, which may be used for the front legs of a baby swing. As with the longer straps, a first strip of hook and loop fasteners 100 adjacent to a first end 102 of the strap can engage either a second strip of hook and loop fasteners 104 adjacent to an opposite second end 106 of the strap to form a larger loop, or a third strip of hook and loop fasteners 108 adjacent to the middle 110 of the strap to form a smaller loop, to enable the length of the loop to be adjusted. Again, a fabric loop 112, having a strip of hook and loop fasteners 114, may be sewn to either end of the strap.

Figure 9:
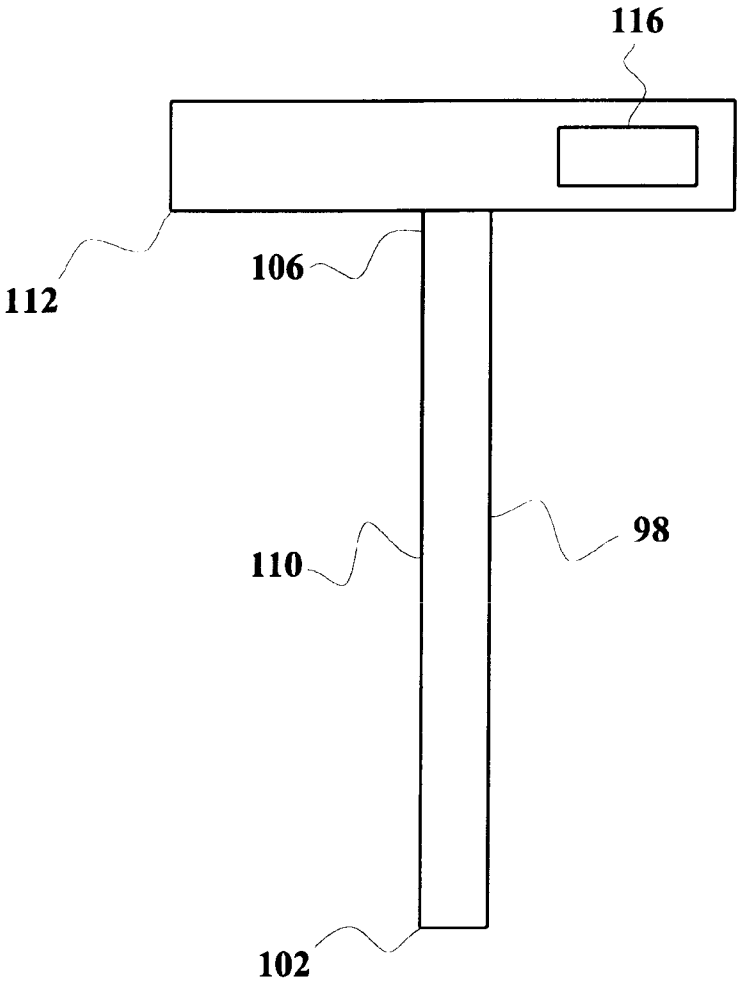
FIG. 9 is a bottom plan view of one of the shorter straps in an open position, in the preferred embodiment of the invention.

FIG. 9 is a bottom plan view of one of the shorter straps in an open position. As with the longer straps, a second strip of hook and loop fasteners 116 can engage the strip of hook and loop fasteners on the other side of the fabric strip, to close the strip into a fabric loop, by which the sling can be retained on narrow elongated objects, such as the legs of a baby swing. Two of the longer straps, two of the shorter straps, and two D-shaped rings constitute the second set of attachments for the sling. The rings are retained on the loops formed by the straps that are attached to the rectangular pad, and one longer strap and one shorter strap ("outer straps") are preferably retained on each ring.

Figure 10:
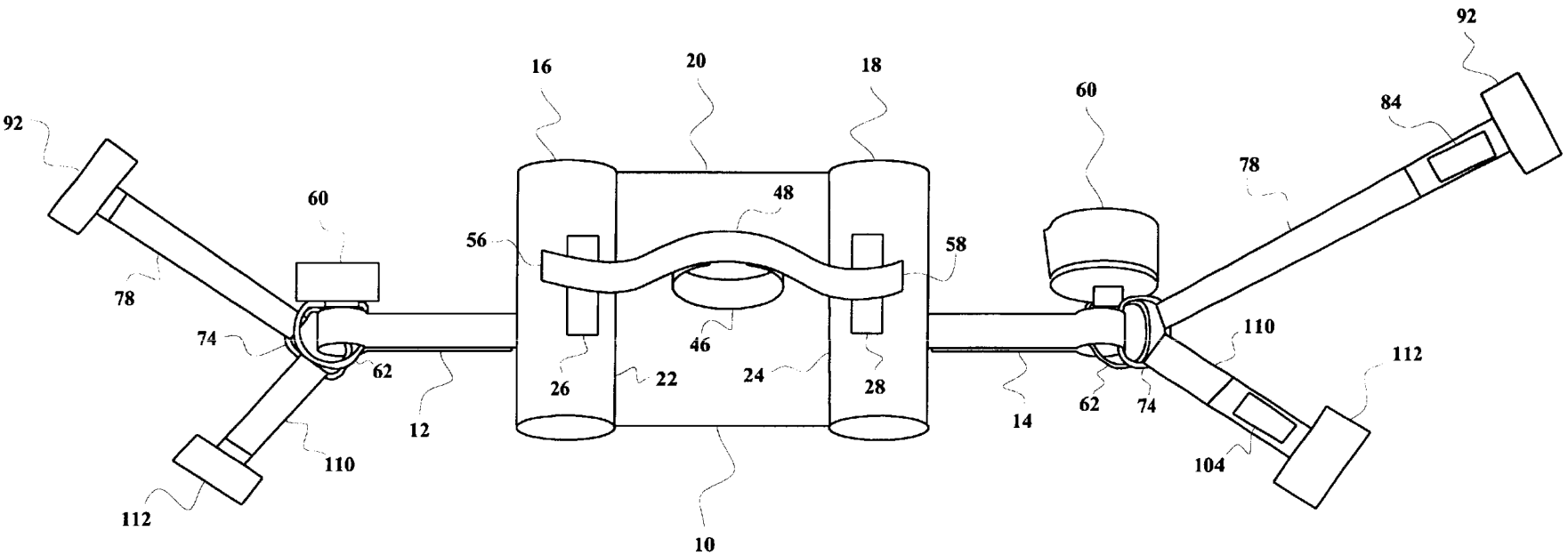
FIG. 10 is a perspective view of the preferred embodiment of the invention, with all the parts assembled.

FIG. 10 is a perspective view of the preferred embodiment of the invention, with all the parts assembled. (Normally, the first and second set of attachments are not used at the same time.)

Figure 11:
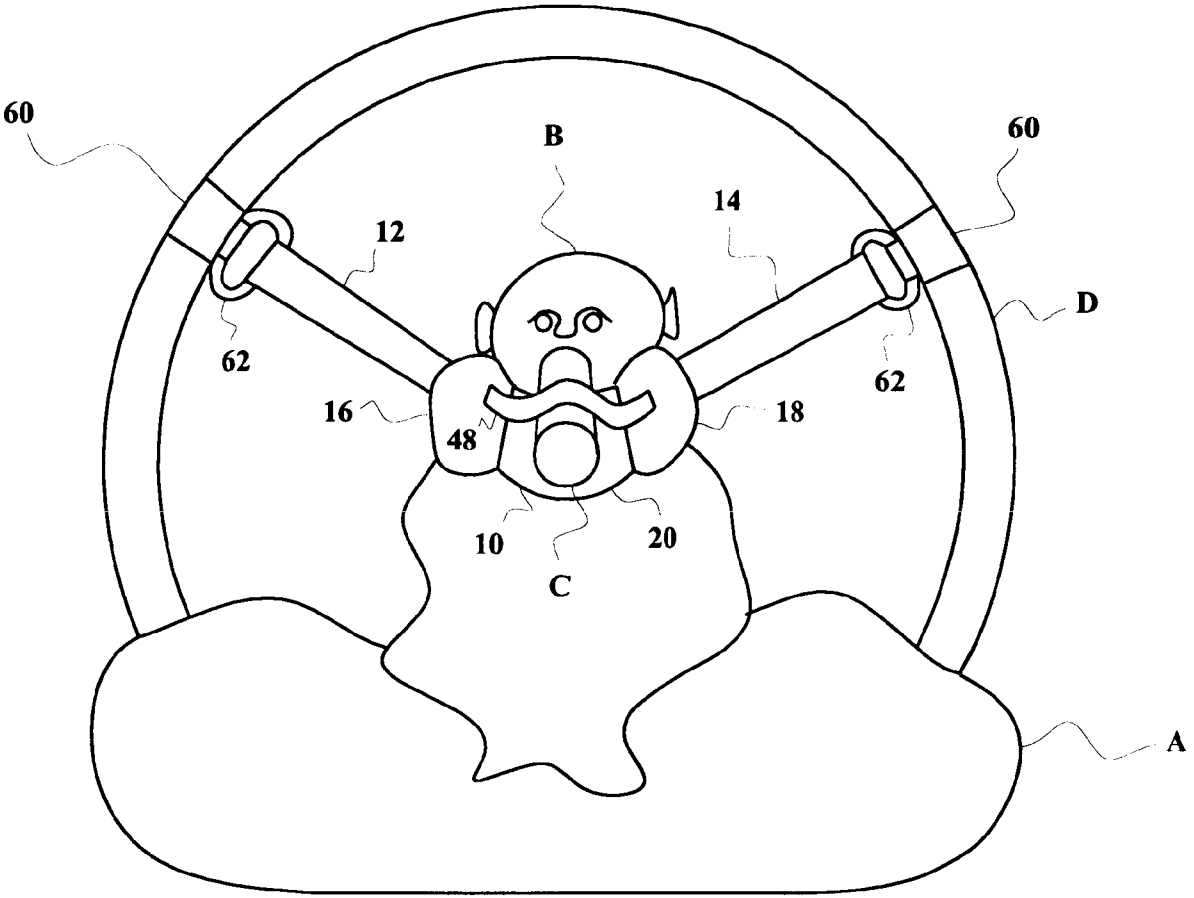
FIG. 11 is an environmental perspective view of the preferred embodiment of the invention, showing the use of the first set of attachments in a baby's car seat.

FIG. 11 is an environmental perspective view of the preferred embodiment of the invention, showing the use of the inner straps 12 and 14 only in a baby's car seat A. A baby B is sucking on a bottle C held by the sling, which is retained on a handle or railing D by the fabric loops 60 of the first set of attachments.

Figure 12:
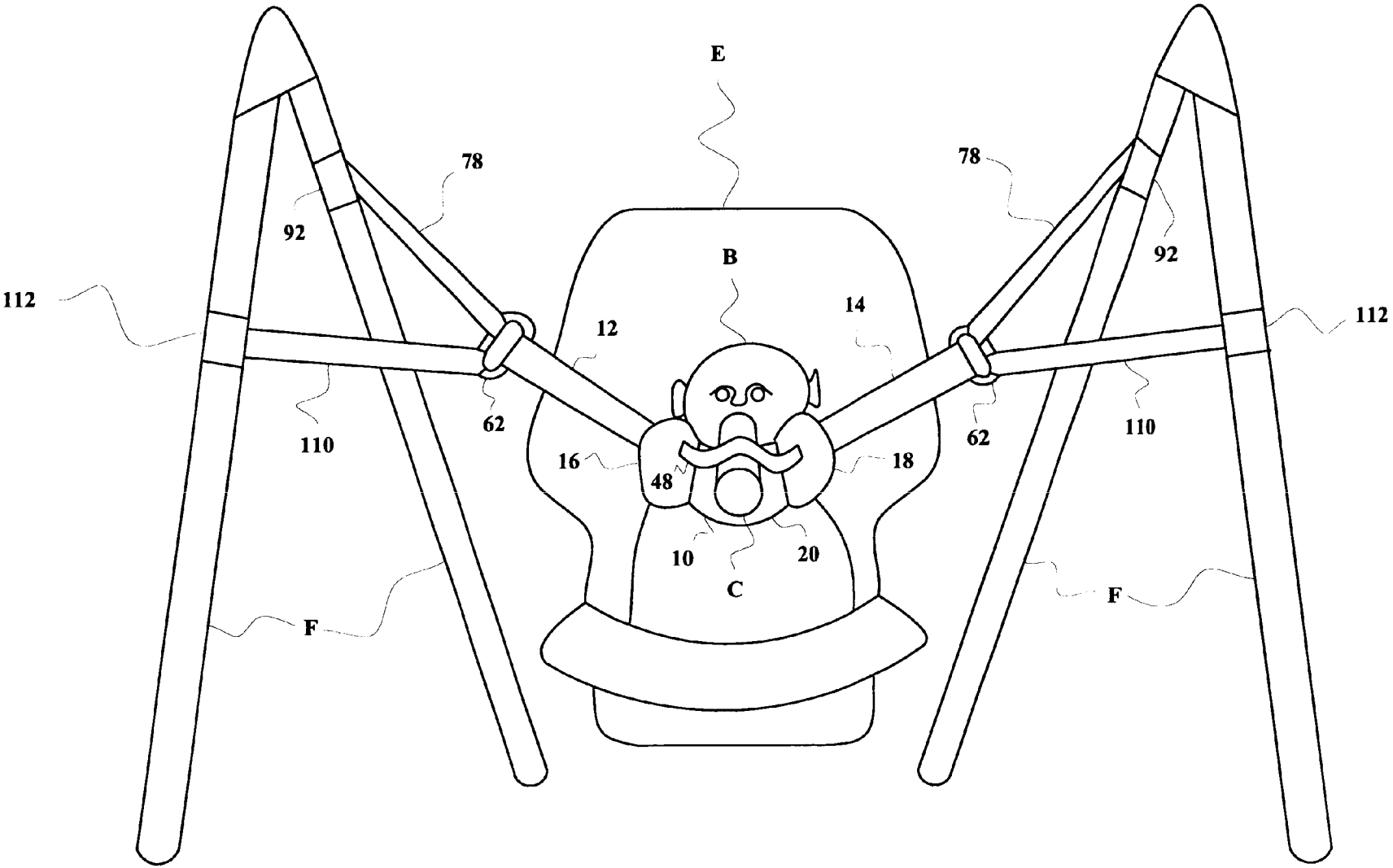
FIG. 12 is an environmental perspective view of the preferred embodiment of the invention, showing the use of the second set of attachments on a baby's swing.

FIG. 12 is an environmental perspective view of the preferred embodiment of the invention, showing the use of the outer straps 78 and 110 on a baby's swing E. Again, a baby B is sucking on a bottle C held by the sling, which is retained on the four legs F of the swing by the fabric loops 92 and 112 of the second set of attachments.

The following instructions for making the invention are included for illustration only, and do not limit the scope of the invention:

A. To Make the Rectangular Pad

1. Cut two pieces of fabric to ten and one-half inches by seven inches.

2. Sew the two long sides together and turn right side out.

3. To divide it into three section, sew a straight stitch three and one-quarter inches from each side. The two pieces of fabric should be held together in the center by two straight stitches one and one-third inches apart.

4. Sew a two-inch piece of loop fasteners to each of the end sections one-quarter inch from the stitch and centered.

5. Before stuffing and sealing the end sections, sew the short sides of the fabric together with a straight stitch, leaving an opening three inches from the end, through which to insert stuffing and attach the straps. (The straps should be slightly off center, so the bottle will tilt towards the baby.)

6. Stuff the end sections with polyester filling.

7. Attach a seven and one-half inch piece of strapping while finishing the edge. Insert one-quarter inch of the strapping into the end section before sewing it closed.

8. Fold the end of the strapping opposite the end that is attached to the fabric rectangle one-quarter inch in and seal with a stitch. (Fold under if the loop fasteners on the fabric rectangle are facing up.)

9. Attach hook and loop fasteners to the strapping. Sew a two-inch strip of hook fasteners one-quarter inch in from the fabric rectangle, and sew a two-inch strip of loop fasteners one-quarter inch from the opposite end of the strapping. (Lay fabric rectangle so that the loop fasteners are facing down, so that the straps will latch toward the back.)

B. To Make the Elastic Loop and Strap to Retain a Bottle on the Fabric Rectangle 1. Cut a piece of strapping eight inches long.

2. Fold over the edges one-quarter inch and seal with a stitch.

3. Sew a one and one-half inch strip of hook fasteners to each end of the strap, one-quarter inch in from the end.

4. Cut a piece of elastic six-inches long and sew it to the center of the strap on the same side as the hook fasteners.

C. To Make the First Set of Attachments

1. Cut four pieces of fabric eight and one-half inches by two and one-quarter inches.

2. Take two of the pieces and place them over the other two pieces, aligning their sides. Seal the two short sides and one long side, with the fabric having right sides facing each other.

3. Flip the fabric right sides out.

4. Cut two one and one-quarter inch pieces of strapping, and attach a D-ring to each, by inserting the strapping through the ring, and sealing with a stitch.

5. Seal the remaining long side, attaching a D-ring to the middle of said long side of each piece of fabric.

6. Attach a two-inch piece of loop fasteners to one side at near one end of each fabric strip. Flip it over and attach a two-inch piece of hook fasteners to the other side near the other end of the strip.

D. To Make the Second Set of Attachments

1. Cut eight pieces of fabric six and one-quarter inches by two inches.

2. Take four of the pieces and place them over the other four pieces, aligning their sides. Seal the two short sides and one long side, with the right sides facing each other, forming four fabric strips.

3. Flip the fabric right sides out.

4. Add an eight-inch piece of strapping to two fabric strips and an eleven and one-half inch piece to two fabric strips. Attach the strapping to the middle of the pieces by inserting one-quarter inch of the strapping into the piece of fabric. Seal the remaining long side. This will create the two longer attachments for the back legs of a baby swing, and the two shorter attachments for the front legs of a baby swing.

5. Attach a one and one-half inch strip of loop fasteners to one side of each fabric strip, one-quarter inch from one end. Flip over, and attach a one and one-half inch strip of hook fasteners to the other side, one-quarter inch from the opposite end.

6. Lay the fabric strips with the loop fasteners facing up.

7. Fold the ends of the straps (opposite the ends at which they are attached to the fabric strip) in one-quarter inch and seal each with a stitch.

8. For the two eight-inch straps, sew a one and one-half inch strip of hook fasteners to the strapping one-quarter inch from the fabric strips, go one inch and sew another one and one-half inch strip of hook fasteners, and sow a two-inch strip of loop fasteners one-quarter inch from the opposite end of the strap.

9. For the two eleven and one-half inch straps, sew a one and one-half inch strip of hook fasteners to the strapping one-quarter inch from the fabric strips, go one and one-half inch and sew another one and one-half inch strip of hook fasteners, and sow a two-inch strip of loop fasteners one-quarter inch from the opposite end of the strap.

Other dimensions may be used, the dimensions given above being merely for illustration.

It is to be understood that the present invention is not limited to the sole embodiment described above, but encompasses any and all embodiments within the scope of the following claims.

I claim:

1. A holder, comprising:

a pad;

a loop attached to a first strap having at least one strip of hook and loop fasteners that can engage at least one strip of hook and loop fasteners on the pad;

second and third straps, each of which is attached at a first end to the pad, each of said straps having a second end opposite the first end, a first strip of hook and loop fasteners adjacent to the first end, and a second strip of hook and loop fasteners adjacent to the second end, said first and second strips being able to engage each other to form a loop in a middle section of the strap; and at least one fabric strip removably retained on the second strap and at least one fabric strip removably retained on the third strap, each of the fabric strips having first side and a second side, and a first end and a second end, with a strip of hook and loop fasteners on the first side adjacent to the first end that can engage a strip of hook and loop fasteners on the second side adjacent to the second end, to form a closed loop.

2. A holder, comprising:

a rectangular pad having two stuffed end sections and an unstuffed middle section, with strips of hook and loop fasteners on an upper surface of the end sections;

a loop attached to a middle portion of a first strap having two end sections with strips of hook and loop fasteners that can engage the strips of hook and loop fasteners on the rectangular pad;

second and third straps, each of which is attached at a first end to one of the end sections of the rectangular pad, each of said straps having a second end opposite the first end, a first strip of hook and loop fasteners adjacent to the first end, and a second strip of hook and loop fasteners adjacent to the second end, said first and second strips being able to engage each other to form a loop in a middle section of the strap; and at least one fabric strip that can be removably retained on the second strap, and at least one fabric strip that can be removably retained on the third strap, each of the fabric strips having a first side and a second side, and a first end and a second end, with a strip of hook and loop fasteners on the first side adjacent to the first end that can engage a strip of hook and loop fasteners on the second side adjacent to the second end, to form a closed loop.

3. A holder according to claim 2, including:

a first ring that can be removably retained on the second strap, and a second ring that can be removably retained on the third strap, each of the rings having a first portion that passes through the loop in the middle section of the strap on which it is retained, and a second portion that is outside the loop.

4. A holder according to claim 3, wherein:

the fabric strips include a first fabric strip that can be, retained on the second strap, which is retained on the first ring by a first short loop of a suitable material sewn to the fabric strip, and a second fabric strip that can be retained on the third strap, which is retained on the second ring by a second short loop of a suitable material sewn to the fabric strip.

5. The holder according to claim 4, including:

a third ring that can be removably retained on the second strap, and a fourth ring that can be removably retained on the third strap, each of the rings having a first portion that passes through the loop in the middle section of the strap on which it is retained, and a second portion that is outside the loop.

6. The holder according to claim 5, including:

at least one outer strap removably retained on the second ring, and at least one outer strap removably retained on the fourth ring, each of said outer straps having a first end, a second end, and a middle portion, with a first strip of hook and loop fasteners attached to the strap adjacent to the first end that is able to engage a second strip of hook and loop fasteners attached to the strap adjacent to the second end to form a larger loop, and a third strip of hook and loop fasteners attached to the middle portion of the strap that can be engaged by the first strip to form a smaller loop.

7. The holder according to claim 6, wherein:

the outer straps comprise a fourth strap and a fifth strap removably retained on the second ring, and a sixth strap and a seventh strap removably retained on the fourth ring; and the fabric strips include a third fabric strip retained on the fourth strap, a fourth fabric strip retained on the fifth strap, a fifth fabric strip retained on the sixth strap, and a sixth fabric strip retained on the seventh strap, with each of the third, fourth, fifth and sixth fabric strips being sewn to one of the ends of the strap on which it is retained.

8. The holder according to claim 7, wherein the loop attached to the first strap is made of an elastic material.

9. The holder according to claim 5, including: at least one outer strap removably retained on the second ring, and at least one outer strap removably retained on the fourth ring, each of said outer straps having a first end, a second end, and a middle portion, with a first strip of hook and loop fasteners attached to the strap adjacent to the first end that is able to engage an elongated second strip of hook and loop fasteners attached to the strap between the second end and the middle portion in a range of positions to form a loop that has a range of sizes.

10. The holder according to claim 9, wherein:

the outer straps comprise a fourth strap and a fifth strap removably retained on the second ring, and a sixth strap and a seventh strap removably retained on the fourth ring; and the fabric strips include a third fabric strip retained on the fourth strap, a fourth fabric strip retained on the fifth strap, a fifth fabric strip retained on the sixth strap, and a sixth fabric strip retained on the seventh strap, with each of the third, fourth, fifth and sixth fabric strips being sewn to one of the ends of the strap on which it is retained.

11. The holder according to claim 5, including:

at least one outer strap removably retained on the second ring, and at least one outer strap removably retained on the fourth ring, each of said outer straps having a first end, a second end, and a middle portion, with a first strip of hook and loop fasteners attached to the strap adjacent to the first end that is able to engage a second strip of hook and loop fasteners attached to the strap adjacent to the second end to form a loop.

12. The holder according to claim 11, wherein:

the outer straps comprise a fourth strap and a fifth strap removably retained on the second ring, and a sixth strap and a seventh strap removably retained on the fourth ring; and the fabric strips include a third fabric strip retained on the fourth strap, a fourth fabric strip retained on the fifth strap, a fifth fabric strip retained on the sixth strap, and a sixth fabric strip retained on the seventh strap, with each of the third, fourth, fifth and sixth fabric strips being sewn to one of the ends of the strap on which it is retained.

13. The holder according to claim 3, including:

at least one outer strap removably retained on the first ring, and at least one outer strap removably retained on the second ring, each of said outer straps having a first end, a second end, and a middle portion, with a first strip of hook and loop fasteners attached to the strap adjacent to the first end that is able to engage a second strip of hook and loop fasteners attached to the strap adjacent to the second end to form a larger loop, and a third strip of hook and loop fasteners attached to the middle portion of the strap that can be engaged by the first strip to form a smaller loop.

14. The holder according to claim 13, wherein:

the outer straps comprise a fourth strap and a fifth strap removably retained on the first ring, and a sixth strap and a seventh strap removably retained on the second ring; and the fabric strips include a first fabric strip retained on the fourth strap, a second fabric strip retained on the fifth strap, a third fabric strip retained on the sixth strap, and a fourth fabric strip retained on the seventh strap, with each of the fabric strips being sewn to one of the ends of the strap on which it is retained.

15. The holder according to claim 14, wherein the loop attached to the first strap is made of an elastic material.

16. The holder according to claim 3, including:

at least one outer strap removably retained on the first ring, and at least one outer strap removably retained on the second ring, each of said outer straps having a first end, a second end, and a middle portion, with a first strip of hook and loop fasteners attached to the strap adjacent to the first end that is able to engage an elongated second strip of hook and loop fasteners attached to the strap between to the second end and the middle portion in a range of positions to form a loop has a range of sizes.

17. The holder according to claim 16, wherein:

the outer straps comprise a fourth strap and a fifth strap removably retained on the first ring, and a sixth strap and a seventh strap removably retained on the second ring; and the fabric strips include a first fabric strip retained on the fourth strap, a second fabric strip retained on the fifth strap, a third fabric strip retained on the sixth strap, and as fourth fabric strip retained on the seventh strap, with each of the fabric strips being sewn to one of the ends of the strap on which it is retained.

18. The holder according to claim 3, including:

at least one outer strap removably retained on the first ring, and at least one outer strap removably retained on the second ring, each of said outer straps having a first end, a second end, and a middle portion, with a first strip of hook and loop fasteners attached to the strap adjacent to the first end that is able to engage a second strip of hook and loop fasteners attached to the strap adjacent to the second end to form a loop.

19. The holder according to claim 18, wherein:

the outer straps comprise a fourth strap and a fifth strap removably retained on the first ring, and a sixth strap and a seventh strap removably retained on the second ring; and the fabric strips include a first fabric strip retained on the fourth strap, a second fabric strip retained on the fifth strap, a third fabric strip retained on the sixth strap, and a fourth fabric strip retained on the seventh strap, with each of the fabric strips being sewn to one of the ends of the strap on which it is retained.

* * * * *